US009480386B2

(12) United States Patent
Thiyagarajan et al.

(10) Patent No.: US 9,480,386 B2
(45) Date of Patent: Nov. 1, 2016

(54) DISHWASHER APPLIANCES HAVING DEFLECTION ASSEMBLIES

(71) Applicant: General Electric Company, Schenectady, NY (US)

(72) Inventors: Ramasamy Thiyagarajan, Louisville, KY (US); Ronald Scott Tarr, Louisville, KY (US); Jeremy Russell Croom, Louisville, KY (US)

(73) Assignee: Haier U.S. Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 14/518,260

(22) Filed: Oct. 20, 2014

(65) Prior Publication Data

US 2016/0106295 A1 Apr. 21, 2016

(51) Int. Cl.

| | |
|---|---|
| ***A47L 15/06*** | (2006.01) |
| ***A47L 15/42*** | (2006.01) |
| ***A47L 15/16*** | (2006.01) |

(52) U.S. Cl.

CPC ..... *A47L 15/4282* (2013.01); *A47L 15/16* (2013.01)

(58) Field of Classification Search

CPC ..... A47L 15/4282

See application file for complete search history.

(56) References Cited

U.S. PATENT DOCUMENTS

2013/0319487 A1* 12/2013 Hong ..... A47L 15/06 134/183

FOREIGN PATENT DOCUMENTS

DE 1191527 * 4/1965

* cited by examiner

*Primary Examiner* — Joseph L Perrin
*Assistant Examiner* — Jason Riggleman
(74) *Attorney, Agent, or Firm* — Dority & Manning, P.A.

(57) ABSTRACT

Dishwasher appliances are provided. A dishwasher appliance includes a tub that defines a wash chamber for receipt of articles for washing, and a rack assembly arranged within the tub. The dishwasher appliance further includes a fluid ejection assembly, the fluid ejection assembly including an ejection head disposed within the wash chamber, the ejection head operable to eject fluid into the wash chamber. In one embodiment, the dishwasher appliance further includes a passive deflection assembly, the passive deflection assembly including a deflection unit disposed within the wash chamber for deflecting fluid from the ejection head towards the rack assembly. In another embodiment, the dishwasher appliance further includes a deflection assembly, the deflection assembly including a deflection unit disposed within the wash chamber for deflecting fluid from the ejection head towards the rack assembly, the deflection assembly further including a magnet operable to move the deflection unit.

13 Claims, 8 Drawing Sheets

DISHWASHER APPLIANCES HAVING DEFLECTION ASSEMBLIES

FIELD OF THE INVENTION

The subject matter of the present disclosure relates generally to dishwasher appliances, and more particularly to dishwasher appliances having deflection assemblies which direct fluid, such as wash fluid, within the tubs of dishwasher appliances.

BACKGROUND OF THE INVENTION

Dishwasher appliances generally include a tub that defines a wash compartment. Rack assemblies can be mounted within the wash compartment of the tub for receipt of articles for washing. In a typically known dishwasher appliance, spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Typically, the spray arms rotate in a circular pattern when operating to direct wash fluid into the tub.

Such presently known dishwasher appliances, however, can be ineffective at directing wash fluid to the corners of the tub. Dishwasher tubs are typically cube shaped, and the circular pattern of rotation of typical spray arms may not effectively direct wash fluid into the corners of such cube shapes.

U.S. Patent Application Publication No. 2013/0319487, filed Jun. 5, 2013 and entitled "Dish Washing Machine" discloses an active motor-driven deflector assembly for directing water within the tub of a washing machine. However, the active and motor-driven nature of such assembly may result in frequent motor component failure, which can in turn require expensive and time-consuming replacement.

Accordingly, improved apparatus for directing fluid flow within the tubs of dishwasher appliances is desired in the art. For example, improved apparatus which can facilitate the direction of fluid into the corners of the tub would be advantageous.

BRIEF DESCRIPTION OF THE INVENTION

In accordance with one embodiment, a dishwasher appliance is provided. The dishwasher appliance includes a tub that defines a wash chamber for receipt of articles for washing, and a rack assembly arranged within the tub. The dishwasher appliance further includes a fluid ejection assembly, the fluid ejection assembly including an ejection head disposed within the wash chamber, the ejection head operable to eject fluid into the wash chamber. The dishwasher appliance further includes a passive deflection assembly, the passive deflection assembly including a deflection unit disposed within the wash chamber for deflecting fluid from the ejection head towards the rack assembly.

In accordance with another embodiment, a dishwasher appliance is provided. The dishwasher appliance includes a tub that defines a wash chamber for receipt of articles for washing, and a rack assembly arranged within the tub. The dishwasher appliance further includes a fluid ejection assembly, the fluid ejection assembly including an ejection head disposed within the wash chamber, the ejection head operable to eject fluid into the wash chamber. The dishwasher appliance further includes a deflection assembly, the deflection assembly including a deflection unit disposed within the wash chamber for deflecting fluid from the ejection head towards the rack assembly, the deflection assembly further including a magnet operable to move the deflection unit.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
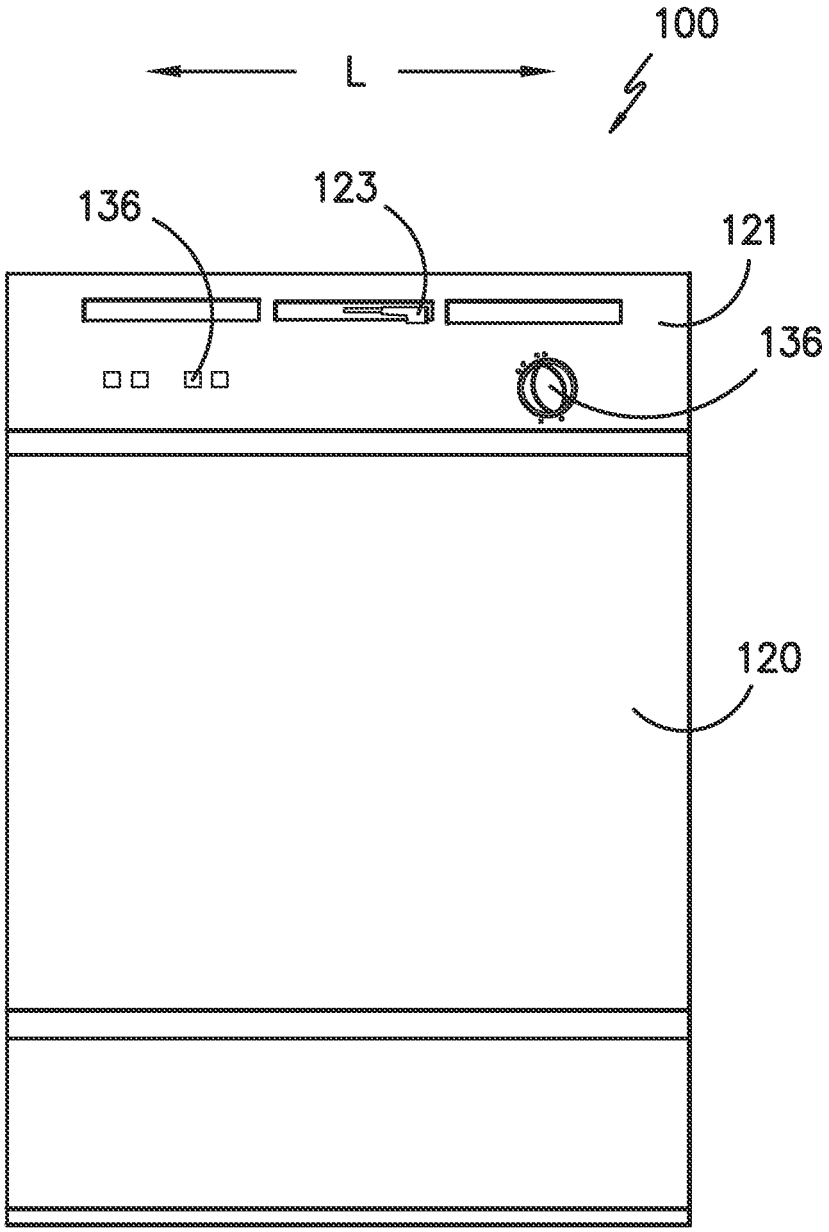
FIG. 1 provides a front view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

Figure 2:
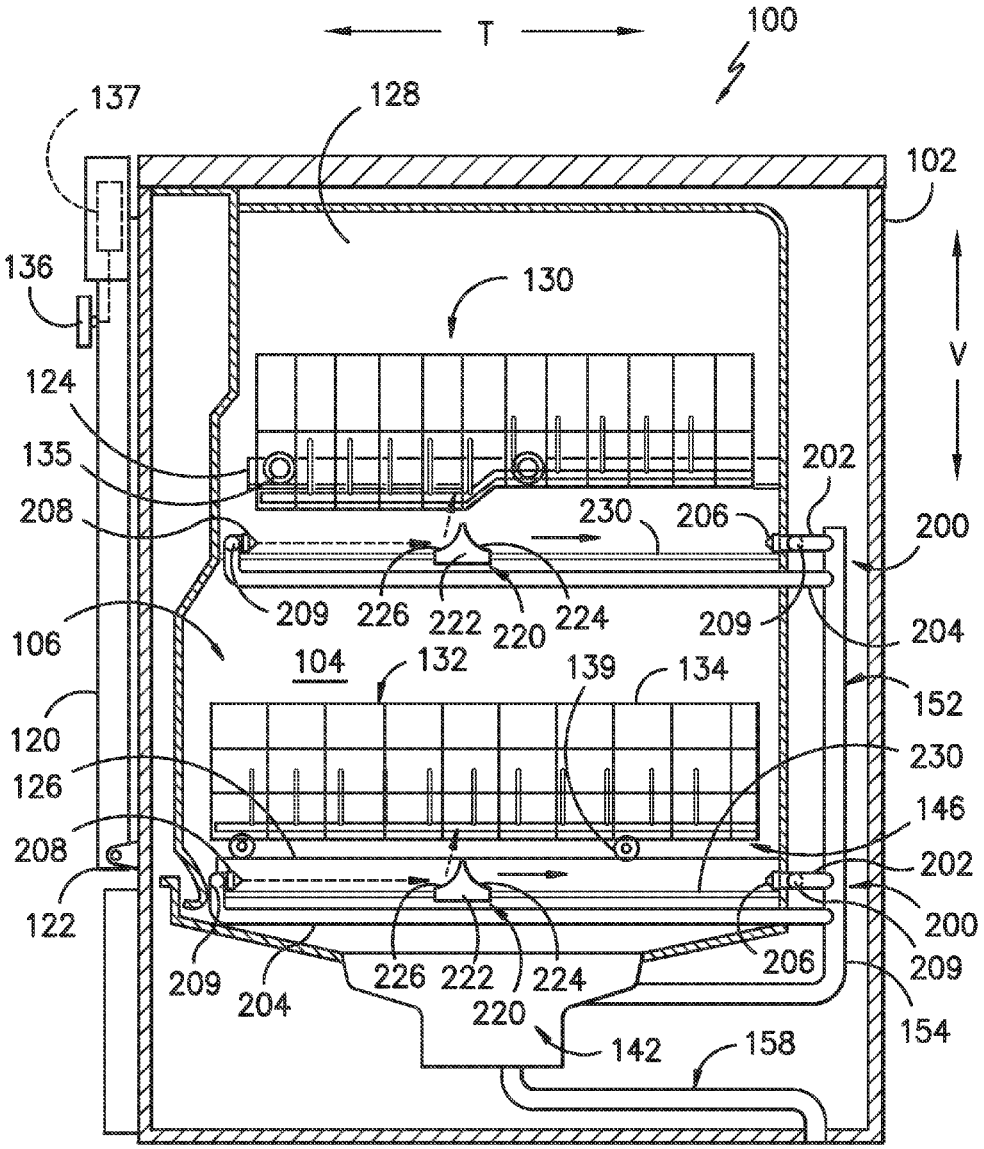
FIG. 2 provides a side cross-sectional view of a dishwasher appliance in accordance with one embodiment of the present disclosure with fluid from second ejection heads causing translation of a deflection unit in a second direction.

FIGS. 1 and 2 depict an exemplary domestic dishwasher appliance 100 that may be configured in accordance with aspects of the present disclosure. For the particular embodiment of FIGS. 1 and 2, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

In the embodiment shown, upper and lower guide rails 124, 126 are mounted on tub side walls 128 and accommodate rack assemblies 130 and 132, which may be roller-equipped. Each of the rack assemblies 130, 132 as shown is fabricated into lattice structures including a plurality of elongated members 134 (for clarity of illustration, not all elongated members making up assemblies 130 and 132 are shown in FIG. 2). Each rack assembly 130, 132 is arranged in the wash chamber 106, such that the rack assembly 130, 132 is capable of movement between an extended loading position (not shown) in which the rack is substantially positioned outside the wash chamber 106, and a retracted position (shown in FIGS. 1 and 2) in which the rack is located inside the wash chamber 106. This is, for example, facilitated by rollers 135 and 139, for example, mounted onto rack assemblies 130 and 132, respectively. A silverware basket (not shown) may be removably attached to rack assembly 132 for placement of silverware, utensils, and the like, that are otherwise too small to be accommodated by the rack assemblies 130, 132.

Dishwasher appliance 100 further includes a fluid circulation assembly 152 for circulating water and dishwasher fluid in the tub 104. Fluid circulation assembly 152 may further include a circulation conduit 154 which supplies the fluid to one or more fluid ejection assemblies, as discussed herein. The conduit 154 may, for example, be in fluid communication with a sump 142 such that fluid can flow from the sump 142 into the conduit 154 as required.

As mentioned, dishwasher assembly 100 further includes sump 142, which may be provided in lower region 146, such as below the rack assemblies 130, 132. Sump 142 generally collects fluid from the wash chamber 106 for circulation within the tub 104, such as back into the wash chamber 106 through fluid circulation assembly 152, as well as drainage from the tub 104 and dishwasher appliance 100 in general. Drainage may occur, for example, through a drain conduit 158 which is provided for draining fluid from the sump 142. The conduit 158 may, for example, be in fluid communication with the sump 142 such that fluid can flow from the sump 142 into the conduit 158 as required. Drain conduit 158 may flow the fluid from the sump 142 to, for example, external plumbing or another suitable drainage location.

The dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for rack assemblies 130, 132, and other differences may be applied as well.

Referring now to FIGS. 2 through 11, dishwasher appliances 100 in accordance with the present disclosure further include various features for directing the flow of fluid into the wash chamber 106 towards the rack assemblies 130, 132 and towards the corners of the tub 104. In particular, dishwasher appliances 100 in accordance with the present disclosure may include deflection assemblies which include movable deflection units. Fluid that is ejected from ejection heads into the wash chamber may contact the deflection units and be generally deflected towards one or more rack assemblies 130, 132. The movement of the deflection units in some embodiments can be translational, such as along generally linear directions (for example, front-to-back and vice versa or side-to-side and vice versa). In other embodiments, the movement of the deflection units can be rotational, with the deflection units pivoting between deflecting positions wherein fluid ejected from the ejection heads contacts the deflection units and bypass positions wherein fluid ejected from the ejection heads bypass the deflection units. Such deflection assemblies may advantageously direct fluid towards the corners of the tub 104, and may additionally be cost-effective and durable solutions for such fluid flow direction.

As illustrated dishwasher assembly 100 may include one or more fluid ejection assemblies 200. Each fluid ejection assembly 200 may, for example, be in fluid communication with the fluid circulation assembly 152, such that fluid flows from the fluid circulation assembly 152 into the fluid ejection assembly 200 and through the fluid ejection assembly 200 for ejection into the wash chamber 106. A fluid ejection assembly 200 may, for example, include one or more conduits, such as first conduits 202 and optional second conduits 204 as shown. The conduits 202, 204 may be in fluid communication with the fluid circulation assembly 152. The conduits 202, 204 may be entirely exterior to the wash chamber 106, or the conduits 202, 204 or portions thereof may be disposed within the wash chamber 106. Fluid ejection assembly 200 may further include, for example, one or more ejection heads, such as first ejection heads 206 and optional second ejection heads 208 as shown. Each ejection head may be disposed within the wash chamber 106 and may be in fluid communication with an associated conduit. Further, each ejection head may be operable to eject fluid therefrom in an ejection direction in the wash chamber 106. Fluid may thus flow from an associated conduit through an ejection head, and be ejected from the ejection head into the wash chamber 106. In embodiments wherein first conduits 202 and associated first ejections heads 206 as well as second conduits 204 and associated second ejections heads 208 are utilized, valves 209 may be utilized to direct flow to the first conduits 202, second conduits 204 or both.

As discussed, fluid may be flowed from each ejection head 206, 208 into the wash chamber 106. Fluid from a first ejection head 206 may flow in a first direction in the wash chamber 106, and fluid from a second ejection head 208 may flow in a second direction in the wash chamber 106. In exemplary embodiments, as shown, the fluid may be flowed into the wash chamber 106 along a generally horizontal path. Further, in some embodiments wherein first ejections heads 206 and second ejections heads 208 are utilized, the second ejection heads 208 may be facing in opposing directions relative to the first ejection heads 206, such that the second direction of fluid flow from the second ejection heads 208 is opposite to the first direction of fluid flow from the first ejection heads 206. It should be understood, however, that any suitable flow path for fluid flowed from the ejection heads 206, 208 is within the scope and spirit of the present disclosure.

Dishwasher assembly 100 may further include one or more deflection assemblies 220. Each deflection assembly 220 is generally operable to deflect fluid flowed into the wash chamber 106 from the ejection heads 206, 208, thus changing the direction of the fluid. Specifically, the fluid flow may be deflected towards one or both rack assemblies 130, 132, such as in a generally vertical direction. Notably, the fluid flow generally along a vertical direction may be generally upwards as illustrated, or generally downwards. Further, the positioning and movement of the deflection assemblies 220 and components thereof may advantageously facilitate the flow the fluid towards the corners of the tub 104, and towards articles in the rack assemblies 130, 132 that are positioned proximate such corners in the wash chamber 106.

A deflection assembly 220 includes one or more deflection units 222. Each deflection unit 222 is disposed within the wash chamber 106 for deflecting fluid from one or more ejection heads 206, 208 towards a rack assembly 130, 132. Further, each deflection unit 222 may be movable within the wash chamber 106. Each deflection unit 222 includes one or more deflection surfaces. Fluid from the ejection heads 206, 208 may contact the deflection surfaces to be deflected and thus change flow direction. For example, a deflection unit 222 may include a first deflection surface 224, which may for example face first ejection heads 206 to deflect fluid flow therefrom. Deflection unit 222 may further, in embodiments wherein second ejection heads are utilized, include a second deflection surface 226, which may for example face second ejection heads 208 to deflect fluid flow therefrom. The second deflection surface 226 may, for example, face opposite to the first deflection unit 224. In exemplary embodiments as illustrated, a deflection surface 224, 226 may have a curvilinear profile. Alternatively, a deflection surface 224, 226 may have a linear profile, or portions thereof may be linear and curvilinear.

Referring now to FIGS. 2 through 8, in some exemplary embodiments, a deflection assembly 220 is a passive deflection assembly. Because the deflection assembly 220 in these embodiments is passive, no active components are included in the assembly 220 to cause movement of the components thereof, such as the deflection units 222. Movement of such components in a passive system is thus caused only by fluid force acting on the components from the ejection heads and, in some embodiments, various passive biasing apparatus.

Figure 3:
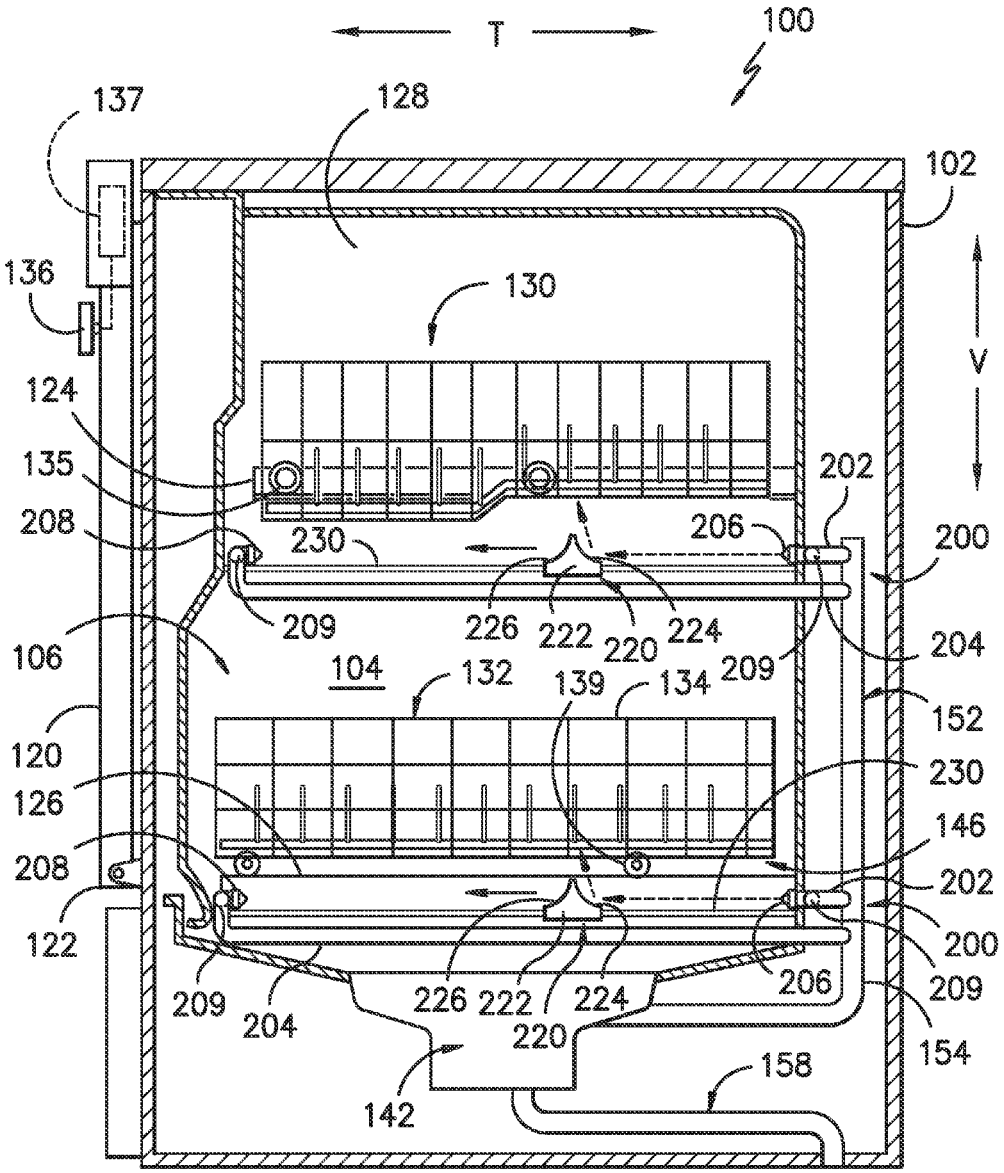
FIG. 3 provides a side cross-sectional view of a dishwasher appliance in accordance with one embodiment of the present disclosure with fluid from first ejection heads causing translation of a deflection unit in a first direction.
Figure 4:
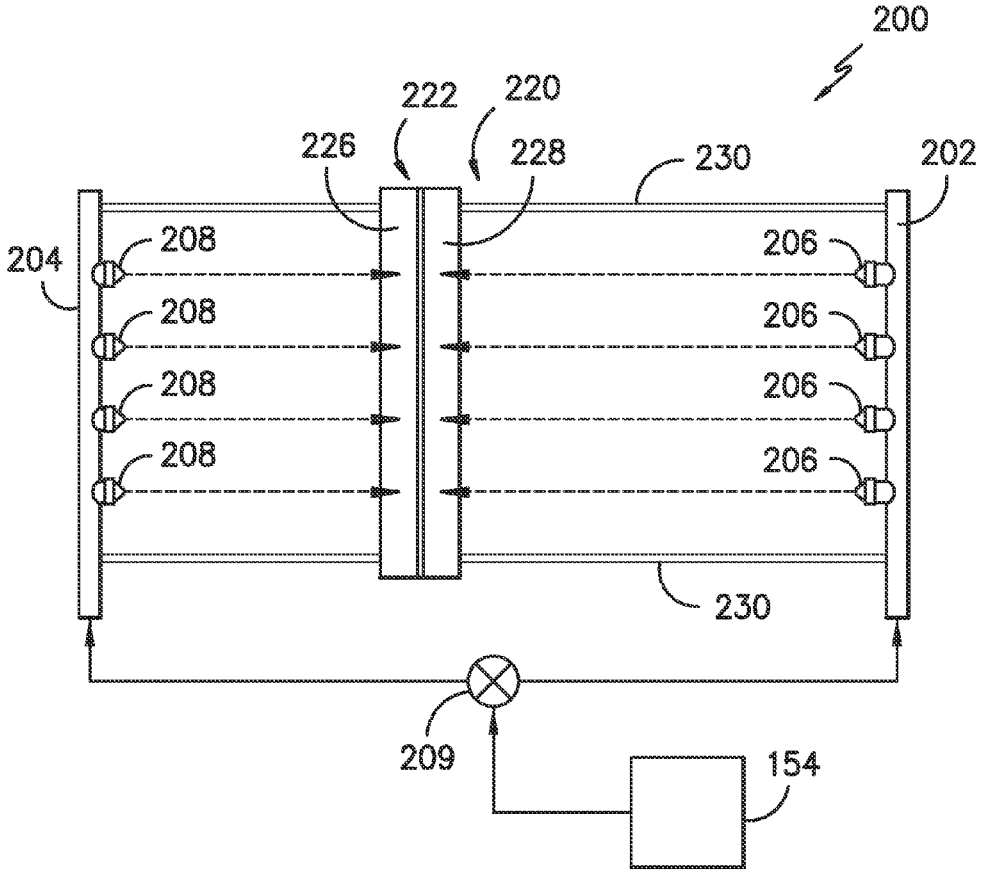
FIG. 4 provides a top cross-sectional view of a dishwasher appliance in accordance with one embodiment of the present disclosure with fluid from first and second ejection heads contacting a deflection unit.

FIGS. 2 through 4 illustrate one embodiment of a passive deflection assembly 220. In these embodiments, each deflection unit 222 includes a first deflection surface 224 for deflecting fluid from one or more first ejection heads 206 and a second opposing deflection surface 226 for deflecting fluid from one or more second ejection heads 208. One or more first ejection heads 206 are operable to eject fluid in a first ejection direction towards the first deflection surface 224, and one or more second ejection heads 208 are operable to eject fluid in a second opposing direction towards the second deflection surface 226. Notably, the deflection assembly 220 may further include one or more guide rails 230, which may for example be rods as shown, channels, or other suitable guide rails. The guide rails 230 may extend generally horizontally within the wash chamber 106, such as in a front-to-back or side-to-side orientation. A deflection unit 222 may be movably connected to the guide rails 230, such as translatably connected as shown. For example, holes may be defined in the deflection unit 222 through which the rods may extend, or the deflection unit 222 may be otherwise movably mounted to the guide rails. The deflection unit may thus be movable, such as translatable, along the guide rails 230 due to fluid force acting on the deflection unit 222.

FIG. 2 illustrated movement of the deflection unit 222 in a second direction towards the first ejection heads 206 due to fluid force on the second deflection surface 226 from the second ejection heads 208. Further, the fluid flowed from the second ejection heads 208 may, after contacting the second deflection surface 226, be deflected to a different direction, such as a generally vertical direction towards a rack assembly 130, 132. Notably, in this embodiment, fluid is flowing only from the second ejection heads 208.

FIG. 3 illustrated movement of the deflection unit 222 in a first direction towards the second ejection heads 208 due to fluid force on the first deflection surface 224 from the first ejection heads 206. Further, the fluid flowed from the first ejection heads 206 may, after contacting the first deflection surface 224, be deflected to a different direction, such as a generally vertical direction towards a rack assembly 130, 132. Notably, in this embodiment, fluid is flowing only from the first ejection heads 206.

FIG. 4 illustrates the deflection unit 222 in a stationary position, due to equal fluid force on the first and second deflection surfaces 224, 226 from the first and second ejection heads 206, 208. Notably, fluid may also be flowed from the first and second ejection heads 206, 208 such that the fluid force on the first and second deflection surfaces 224, 226 is unequal, so that the deflection unit 222 moves in the first or second direction. The disparity in force may be adjusted to control the speed with which the deflection unit 222 travels in the first or second direction.

Figure 7:
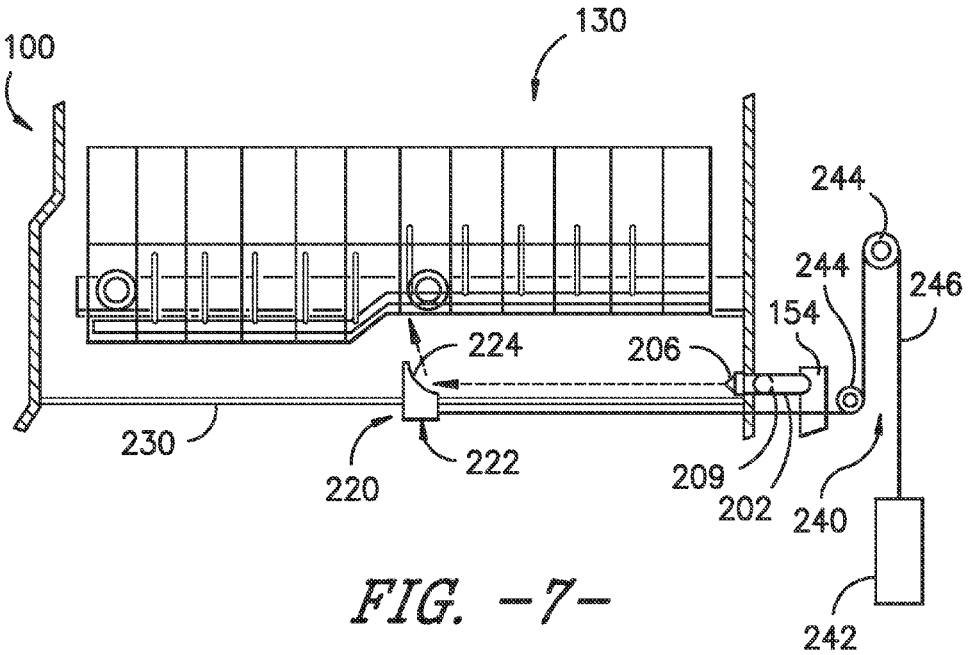
FIG. 7 provides a partial side cross-sectional view of a dishwasher appliance in accordance with one embodiment of the present disclosure with fluid from an ejection head causing translation of a deflection unit in a first direction and an embodiment of a mechanical energy storage device biasing the deflection unit in a second opposing direction.
Figure 8:
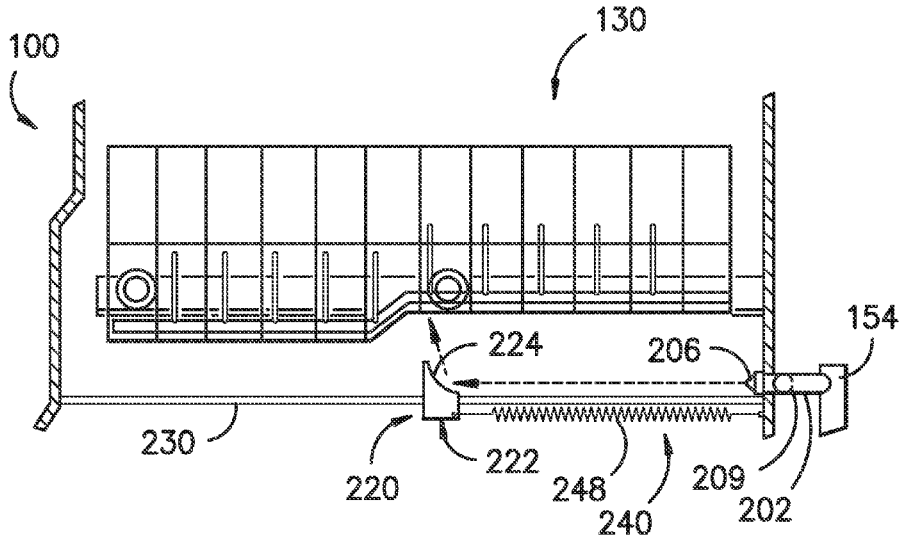
FIG. 8 provides a partial side cross-sectional view of a dishwasher appliance in accordance with one embodiment of the present disclosure with fluid from an ejection head causing translation of a deflection unit in a first direction and another embodiment of a mechanical energy storage device biasing the deflection unit in a second opposing direction.

Referring now to FIGS. 7 and 8, in alternative embodiments, a passive deflection assembly 220 may include one or more mechanical energy storage devices 240. Each mechanical energy storage device 240 biases the associated deflection unit 222 towards one or more ejection heads. For example, in the embodiments shown, only first ejection heads 206 are utilized, and the deflection unit 222 only includes first deflection surface 224. The deflection unit 222 is translatable on guide rails 230. Accordingly, fluid force from the first ejection heads 206 causes movement of the deflection unit 222 in a first direction away from the first ejection heads 206. Further, the fluid flowed from the first ejection heads 206 may, after contacting the first deflection surface 224, be deflected to a different direction, such as a generally vertical direction towards a rack assembly 130, 132. Notably, in these embodiments, the fluid force must be high enough to overcome the biasing force of the mechanical energy storage devices 240 for the deflection unit 222 to move away from the ejection heads 206. When the biasing force of the mechanical energy storage devices 240 is higher than the fluid force, the deflection unit 222 may move towards the ejection heads 206. When the biasing force and the fluid force are equal the deflection unit 222 may be stationary.

In some embodiments, as shown in FIG. 7, a mechanical energy storage device 240 may include a pulley assembly and a load member 242. The pulley assembly may include one or more pulleys 244. The device 240 may further include a connecting member 246, which may be a rope, chain, etc. The connecting member 244 may connect the deflection unit 222 and the load member 242, which have a suitable mass to provide a suitable biasing force to the deflection unit 222. The connecting member 246 may be movable along the pulleys 244 due to movement of the deflection unit 222 and the load member 242 based on the disparity between the biasing force and the fluid force.

In other embodiments, as shown in FIG. 8, a mechanical energy storage device 240 may include a spring 248. The spring 248 may be connected to the deflection unit 222 at one end and, for example, the tub 104 or another suitable component of the appliance 100 at the other end. As the deflection unit 222 moves away from the ejection heads 206, the biasing force of the spring 248 may increase, as is generally understood.

Figure 5:
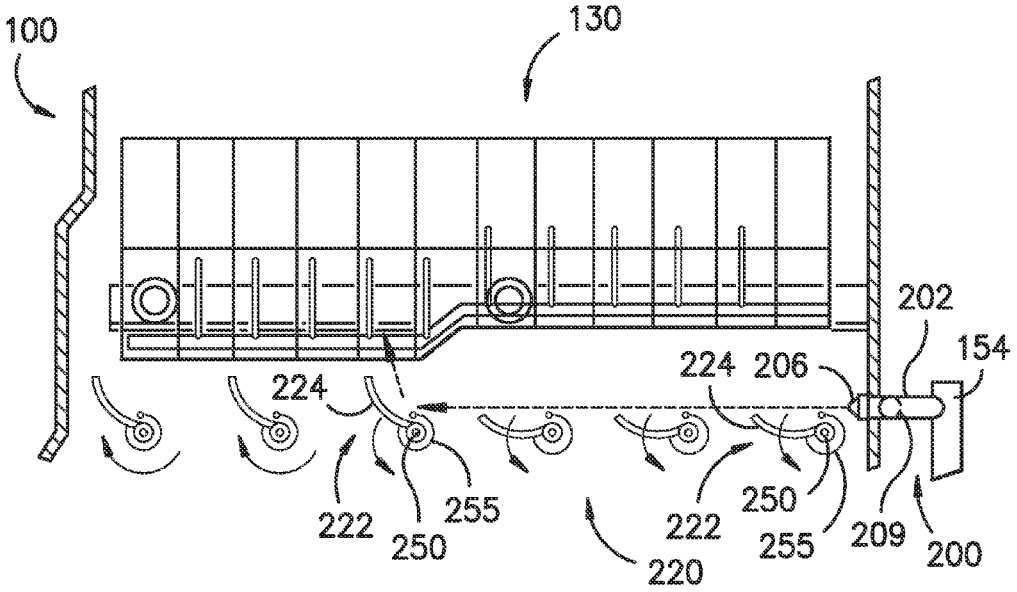
FIG. 5 provides a partial side cross-sectional view of a dishwasher appliance in accordance with one embodiment of the present disclosure with fluid from an ejection head causing rotation of various deflection units into bypass positions.
Figure 6:
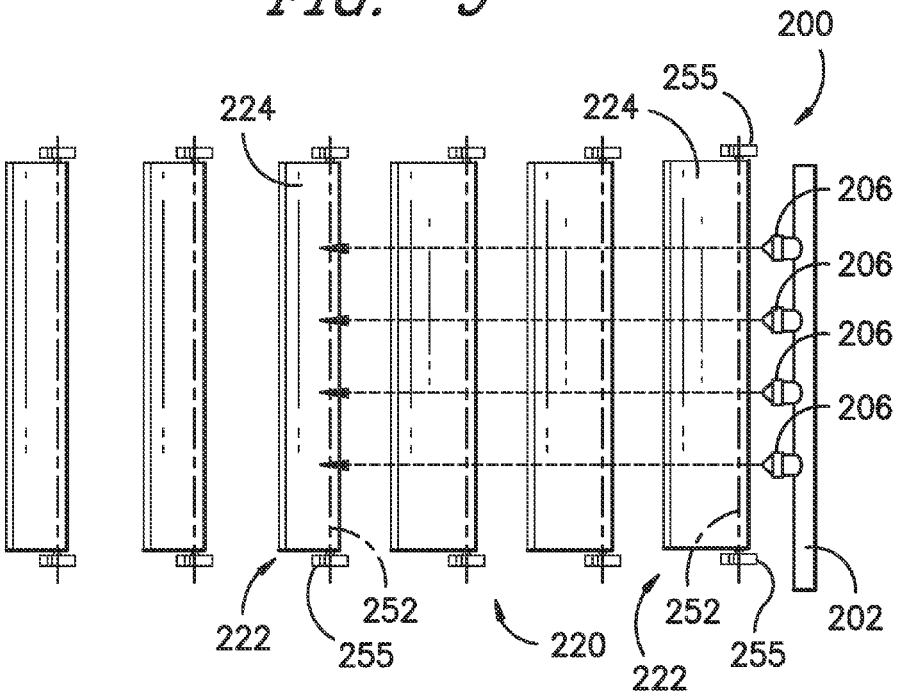
FIG. 6 provides a top cross-sectional view of a dishwasher appliance in accordance with one embodiment of the present disclosure with fluid from ejection heads causing rotation of various deflection units into bypass positions.

Referring now to FIGS. 5 and 6, in alternative embodiments, a passive deflection assembly 220 may include one or more pivot rails 250. A deflection unit 222 may be connected to the pivot rail 250. In exemplary embodiments, each pivot rail 250 is for example a rod. Further, in exemplary embodiments as shown, a plurality of deflection units 222 and a plurality of pivot rails 250 are utilized, with a deflection unit 222 connected to each pivot rail 250. The plurality of pivot rails 250 and associated deflection units 222 may be spaced apart, such as along the direction of flow of fluid from the associated ejection head. Further, each deflection unit 222 may be rotatable about a pivot axis 252 defined by the connected pivot rail 250 (such as extending longitudinally through the pivot rail 250). In particular, the deflection unit 222 may be rotatable about the pivot axis 252 due to fluid force acting on the deflection unit 222. A deflection unit 222 may be rotatable relative to the associated pivot rail 250, or the deflection unit 222 may be fixidly connected to the pivot rail 250 and both the deflection unit 222 and pivot rail 250 may be rotatable.

As shown, each deflection unit 222 may be rotatable between a deflecting position, wherein fluid ejected from ejection heads such as heads 206 contacts the deflection unit 222, and a bypass position, wherein fluid ejected from ejection heads such as heads 206 bypasses and thus generally does not contact the deflection unit 222. As illustrated, fluid from ejection heads 206 contacts the first surface 224 of a deflection unit 222. When the fluid is contacting the first surface 224, the deflection unit 222 is in a deflecting position. When the fluid force is high enough, however, the fluid force may cause the deflection unit 222 to rotate to the bypass position. The fluid may then contact the first surface 224 of a subsequent deflection unit 222. FIG. 5 illustrates a plurality of deflection units 222 in bypass positions and a plurality of deflection units 222 in deflecting positions.

As further illustrated in FIGS. 5 and 6, the passive deflection assembly 220 may further include one or more biasing elements 255. Each biasing element 255 may bias an associated deflection unit 222 towards a deflecting position. In exemplary embodiments, a biasing element 255 is a spring, as shown. The spring may be connected between the deflection unit 222 and pivot rail 250, or between the pivot rail 250 or deflection unit 222 and tub 104 or other suitable component. Accordingly, the fluid force may be required to overcome the biasing force to rotate the deflection unit 222 into the bypass position. Notably, biasing elements 255 with generally identical or varying biasing forces may be utilized for each of the plurality of deflection units 222.

Figure 9:
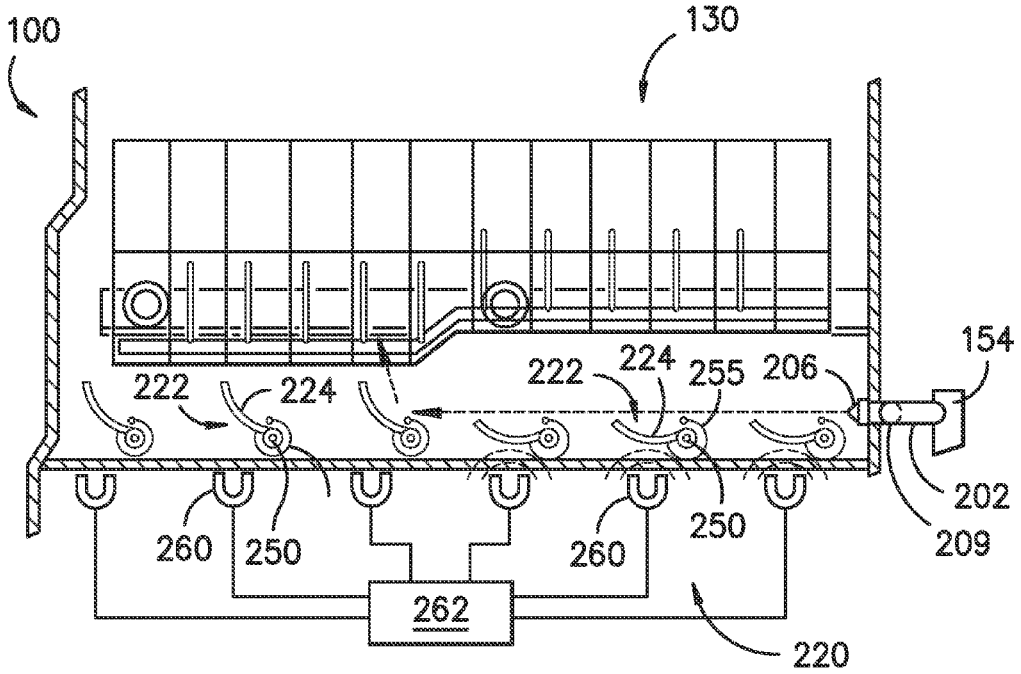
FIG. 9 provides a partial side cross-sectional view of a dishwasher appliance in accordance with one embodiment of the present disclosure with activated magnets causing rotation of deflection units into bypass positions.
Figure 10:
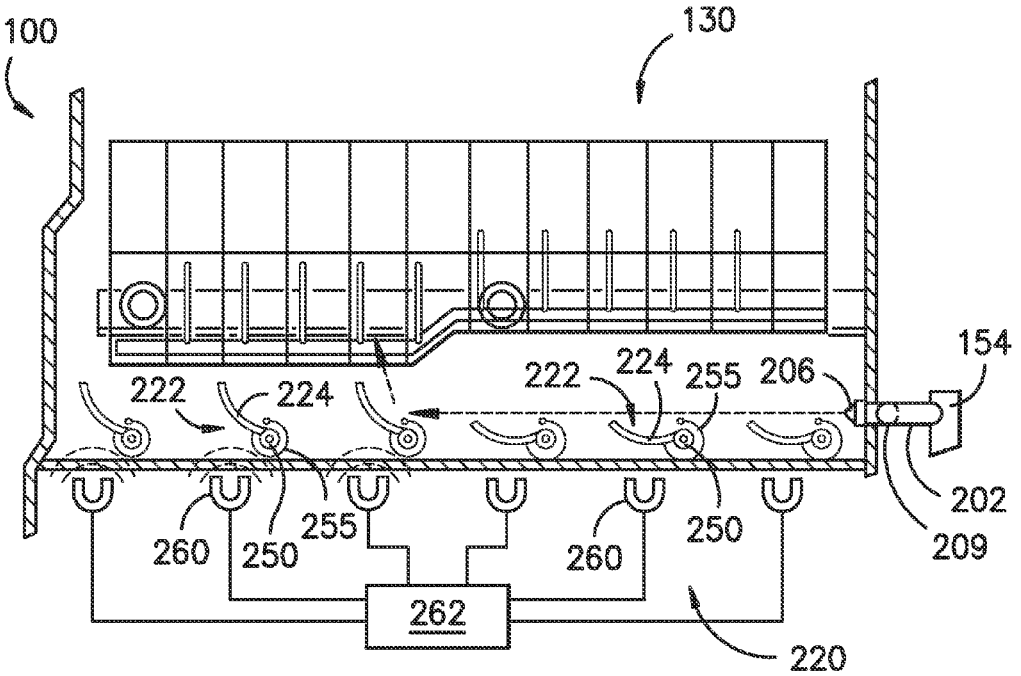
FIG. 10 provides a partial side cross-sectional view of a dishwasher appliance in accordance with one embodiment of the present disclosure with activated magnets causing rotation of deflection units into deflecting positions.
Figure 11:
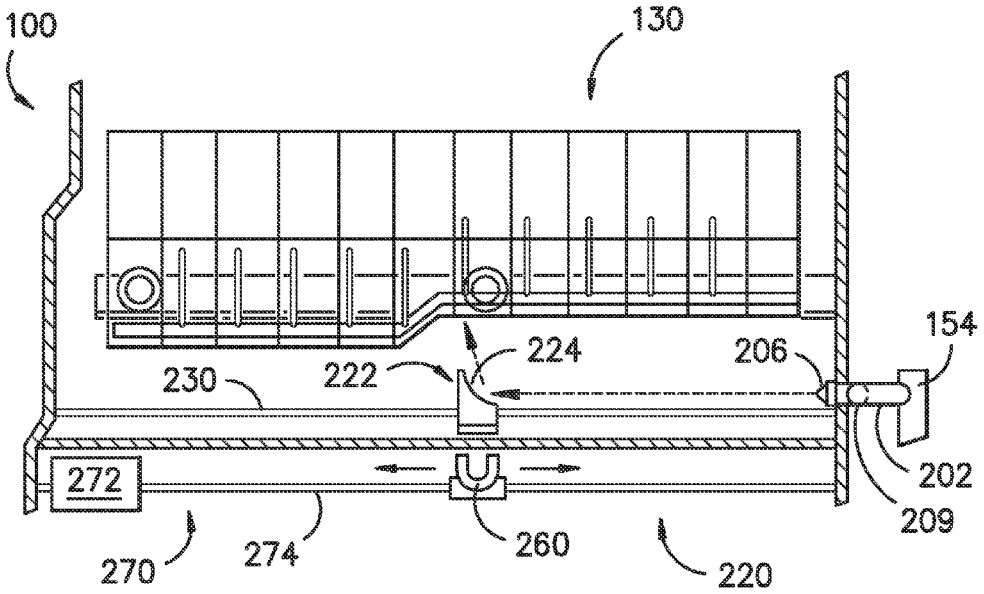
FIG. 11 provides a partial side cross-sectional view of a dishwasher appliance in accordance with one embodiment of the present disclosure with translation of a magnet causing translation of a deflection unit.

Referring now to FIGS. 9 through 11, in other exemplary embodiments, a deflection assembly 220 may utilize magnetic fields to cause movement of the various components thereof, such as the deflection units 222. Accordingly, a deflection assembly 220 may, for example, further include one or more magnets 260, each of which may be operable to move a deflection unit 222. In some embodiments, as illustrated in FIGS. 9 and 10, a magnet 260 may be an electromagnet, which may be actuated such that the magnetic fields emanating from the magnet 260 are activated or deactivated as desired. Activation of an electromagnet occurs due to receipt of electrical current by the electromagnet. In these embodiments, deflection assembly 220 may additionally include one or more power sources 262 in electrical communication with the magnets 260, which may provide electrical current to the magnet(s) 260 to activate the magnets(s) 260. In other embodiments, as illustrated in FIG. 11, a magnet 260 may be a permanent magnet which constantly emanates a magnetic field.

In exemplary embodiments, the magnets 260 may be disposed external to the tub 104, as shown. Further, it should be noted that in the embodiments illustrated in FIGS. 9 through 11, magnets 260 interact with the deflection units 222 directly to move the deflection units 222. In these embodiments, the deflection units 222 are thus formed from suitable magnetic materials. Alternatively, however, additional magnets may be connected to the deflection units 222 to interact with the magnets 260, and deflection units 222 need not be formed from magnetic materials.

Referring now to FIG. 11, in the embodiment shown, only first ejection heads 206 are utilized, and the deflection unit 222 only includes first deflection surface 224. The deflection unit 222 is translatable on guide rails 230. The deflection unit 222 is movably, such as translatably, connected to the guide rails 230. Further, the deflection unit 222 is movable, such as translatable, along the guide rails 230 due to translation of a magnet 260. Accordingly, the magnet 260 may additionally be movable, such as translatable along the translational direction of the deflection unit 222.

For example, in exemplary embodiments, a deflection assembly 220 may include a drive assembly 270, which may for example include a motor 272 which is operably connected to a drive rail 274. The magnet 260 may be translatably connected to the drive assembly 270. For example, the drive rail 274 may be operable to translate the magnet 260 are desired. Drive rail 274 may, for example, be a worm or rack gear, which may for example be driven by a worm gear or pinion gear, as is generally understood. Other suitable drive rails 274 which facilitate such translational movement of the magnet 260 are additionally within the scope and spirit of the present disclosure. Operation of the motor 272 may drive the drive rail 274, which may in turn cause translation of the magnet 260. Due to the magnetic interaction between the magnet 260 and deflection unit 222, the deflection unit 222 may translate in response to translation of the magnet 260.

Referring now to FIGS. 9 and 10, in the embodiments shown, deflection assembly 220 includes pivot rails 250, and deflection units 222 connected to the pivot rails 250. Each deflection unit 222 is rotatable about a pivot axis 252 defined by the connected pivot rail 250. Further, deflection assembly includes a plurality of magnets 260. A magnet 260 may, for example, be associated with each deflection unit 222, as shown. Each deflection unit 222 may be rotatable about a pivot axis 252 an associated pivot rail 250 based on actuation of an associated magnet 260, which in these embodiments may be an electromagnet.

For example, actuation of an associated magnet 260 may move the associated deflection unit 222 between a deflecting position and a bypass position. In the embodiment shown in FIG. 9, a deflection unit 222 is rotatable towards a deflecting position when an associated electromagnet 260 is deactivated and rotatable towards a bypass position when an associated electromagnet 260 is activated. In the embodiment shown in FIG. 10, a deflection unit 222 is rotatable towards a deflecting position when an associated electromagnet 260 is activated and rotatable towards a bypass position when an associated electromagnet 260 is deactivated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance, comprising:

a tub that defines a wash chamber for receipt of articles for washing;

a rack assembly arranged within the tub;

a fluid ejection assembly, the fluid ejection assembly comprising an ejection head disposed within the wash chamber, the ejection head operable to eject fluid into the wash chamber; and a passive deflection assembly, the passive deflection assembly comprising a movable deflection unit disposed within the wash chamber for deflecting fluid from the ejection head towards the rack assembly and a pivot rail, the deflection unit connected to the pivot rail and rotatable about a pivot axis defined by the pivot rail between a deflecting position wherein fluid ejected from the ejection head contacts the deflection unit and a bypass position wherein fluid ejected from the ejection head bypasses the deflection unit, wherein movement of the deflection unit is caused by fluid force acting on the deflection unit.

2. The dishwasher appliance of claim 1, wherein the fluid ejection assembly comprises a plurality of ejection heads, the plurality of ejection heads comprising a first ejection head operable to eject fluid in a first ejection direction and a second ejection head operable to eject fluid in a second opposing ejection direction.

3. The dishwasher appliance of claim 1, wherein the passive deflection assembly further comprises a mechanical energy storage device, the mechanical energy storage device biasing the deflection unit towards the ejection head.

4. The dishwasher appliance of claim 3, wherein the mechanical energy storage device comprises a spring.

5. The dishwasher appliance of claim 1, wherein the passive deflection assembly further comprises a biasing element, the biasing element biasing the deflection unit towards a deflecting position wherein fluid ejected from the ejection head contacts the deflection unit.

6. The dishwasher appliance of claim 1, wherein the passive deflection assembly comprises a plurality of movable deflection units.

7. The dishwasher appliance of claim 1, wherein the deflection unit comprises a deflection surface, the deflection surface having a generally curvilinear profile.

8. A dishwasher appliance, comprising:

a tub that defines a wash chamber for receipt of articles for washing;

a rack assembly arranged within the tub;

a fluid ejection assembly, the fluid ejection assembly comprising an ejection head disposed within the wash chamber, the ejection head operable to eject fluid into the wash chamber; and a deflection assembly, the deflection assembly comprising a deflection unit disposed within the wash chamber for deflecting fluid from the ejection head towards the rack assembly, the deflection assembly further comprising a magnet operable to move the deflection unit, wherein the magnet is an electromagnet, and wherein the deflection assembly further comprises a pivot rail, the deflection unit connected to the pivot rail and rotatable about a pivot axis defined by the pivot rail based on actuation of the electromagnet.

9. The dishwasher appliance of claim 8, wherein the deflection unit is rotatable towards a deflecting position when the electromagnet is deactivated and rotatable towards a bypass position when the electromagnet is activated, wherein fluid ejected from the ejection head contacts the deflection unit in the deflecting position and fluid ejected from the ejection head bypasses the deflection unit in the bypass position.

10. The dishwasher appliance of claim 8, wherein the deflection unit is rotatable towards a deflecting position when the electromagnet is activated and rotatable towards a bypass position when the electromagnet is deactivated, wherein fluid ejected from the ejection head contacts the deflection unit in the deflecting position and fluid ejected from the ejection head bypasses the deflection unit in the bypass position.

11. The dishwasher appliance of claim 8, wherein the magnet is disposed external to the tub.

12. The dishwasher appliance of claim 8, wherein the deflection assembly comprises a plurality of deflection units.

13. The dishwasher appliance of claim 8, wherein the deflection unit comprises a deflection surface, the deflection surface having a generally curvilinear profile.

* * * * *